United States Patent [19]

Scherenberg

[11] 3,955,539

[45] May 11, 1976

[54] ROTARY PISTON INTERNAL COMBUSTION ENGINE

[75] Inventor: Hans O. Scherenberg, Stuttgart, Germany

[73] Assignee: Daimler-Benz Aktiengesellschaft, Germany

[22] Filed: Dec. 6, 1974

[21] Appl. No.: 530,271

[30] Foreign Application Priority Data

Dec. 8, 1973 Germany ..... 2361214

[52] U.S. Cl. ..... 123/8.09; 123/8.45

[51] Int. Cl.[2] ..... F02B 53/12

[58] Field of Search ..... 123/8.01, 8.09, 8.11, 123/8.13, 8.45, 148 DS; 418/61 A

[56] References Cited

UNITED STATES PATENTS 3,344,778 10/1967 Bensinger ..... 123/8.13 X

*Primary Examiner*—Carlton R. Croyle
*Assistant Examiner*—Michael Koczo, Jr.
*Attorney, Agent, or Firm*—Craig & Antonelli

[57] ABSTRACT

A rotary piston internal combustion engine, particularly of trochoidal construction, with a polygonal piston in a multi-arched housing casing in which the piston is provided with combustion space recesses in its piston flanks whereby the ignition takes place into the combustion space recesses; the combustion space recess arranged in a given piston flank is thereby offset with respect to the other combustion space recess or recesses in the other piston flank or flanks.

11 Claims, 1 Drawing Figure

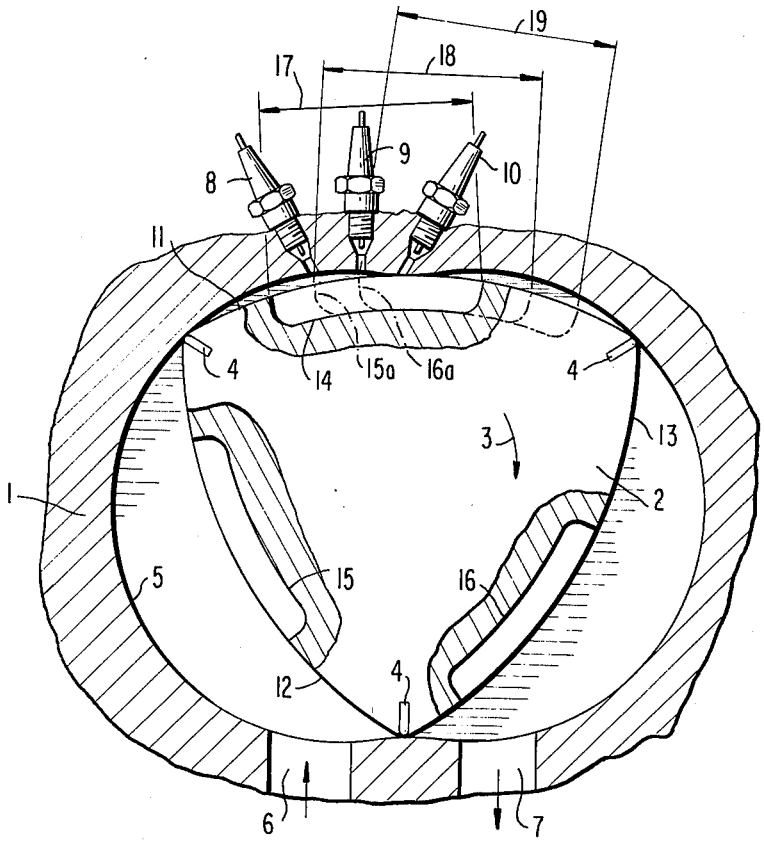
19
18
17
9
8
10
11
4
14
15a
16a
4
3
13
1
2
5
15
16
12
4
6
7

ROTARY PISTON INTERNAL COMBUSTION ENGINE

The present invention relates to a rotary piston internal combustion engine, especially of trochoidal construction, with a polygonal piston within a multi-arched housing casing, in which the piston includes combustion space troughs or recesses in its piston flanks, into which takes place the ignition.

With rotary piston internal combustion engines of trochoidal type of construction, that wall part of the housing casing is thermally particularly highly loaded or stressed which at the instant of the ignition delimits the compression volume together with the combustion space recess in the piston flank because no scavenging with fresh gas takes place at this place. This high thermal load of the housing casing leads to the fact that corrosion-protective oil admixed to the cooling water of the internal combustion engine bakes on or bakes fast in the water space of the housing casing and leads to an insulation. An overheating occurs as a result of the insulation which leads to destructive appearances at the running surface for the piston. The length of life of the internal combustion engine is considerably impaired.

The present invention is therefore concerned with the task to eliminate the described disadvantages with simple means, and the underlying problems are solved according to the present invention in that in each piston flank the combustion space trough or recess coordinated thereto is arranged offset or displaced with respect to the combustion space troughs or recesses in the other piston flanks.

It is achieved advantageously by the present invention that the point of concentration of the combustion during the rotation of the piston is subjected to a local displacement and the thermal load and stress is distributed over a larger surface of the housing casing. Overheatings which lead to damages at the running surface for the piston no longer occur.

In one advantageous embodiment of the inventive concept, the combustion space recesses may be arranged offset in the circumferential direction of the piston.

An additional reduction of the thermal load can be achieved according to a further feature of the present invention in that at least two spark plugs are provided at the housing casing, by means of which an alternate ignition with only one ignition in a given combustion space recess takes place.

In an internal combustion engine with a triangular piston in a two-arched housing casing, three spark plugs arranged offset in the circumferential direction may be provided in or at the housing casing and one combustion space recess in a piston flank may be coordinated to each spark plug whose offset in the circumferential direction of the piston corresponds to the offset of the corresponding spark plug.

Accordingly, it is an object of the present invention to provide a rotary piston internal combustion engine, especially of trochoidal construction, which avoids by simple means the aforementioned shortcomings and drawbacks encountered in the prior art.

Another object of the present invention resides in a rotary piston internal combustion engine which effectively far-reachingly reduces the high thermal loads in the housing casing which occurred heretofore.

A further object of the present invention resides in a rotary piston internal combustion engine, especially of trochoidal construction, in which the point of concentration of the combustion is subjected to a local displacement during the rotation of the piston.

Still a further object of the present invention resides in a rotary piston internal combustion engine which effectively avoids overheating appearances that led heretofore to damages at the running surface for the piston.

Another object of the present invention resides in a rotary piston internal combustion engine of the type described above which greatly improves the length of life of the internal combustion engine by distributing thermal stresses over a larger surface of the housing casing.

These and further objects, features and advantages of the present invention will become more apparent from the following description when taken in connection with the accompanying drawing which shows, for purposes of illustration only, one embodiment in accordance with the present invention, and wherein:

The single FIGURE is a schematic cross-sectional view through a rotary piston internal combustion engine in accordance with the present invention.

Referring now to the single FIGURE of the drawing, within a two-arched housing casing 1 of a rotary piston internal combustion engine of trochoidal type of construction is arranged a triangular piston 2 which rotates in the direction of arrow 3 and slides with its sealing bars 4 provided at its corners along the running or contact surface 5 within the housing casing 1. Within the area of the minor axis of the housing casing 1, the inlet channel 6 and exhaust channel 7 are provided on one side thereof and three spark plugs 8, 9 and 10 arranged mutually offset in the circumferential direction are provided on the other side thereof. The ignition system generally designated by the reference numeral 20 belonging to these spark plugs is so constructed by conventional means that at the same ignition instant, an alternate ignition of the spark plugs with only one ignition into a respective compression volume takes place. Since an ignition system 20 in which three spark plugs are caused to produce sequentially the ignition spark are known as such in the art and involve commercially available parts, a detailed description thereof is dispensed with herein.

Combustion space recesses 14, 15 and 16 are provided in the three piston flanks 11, 12 and 13, respectively, of the piston 2 which are constructed of equal size among each other but are disposed with respect to each other mutually offset in the piston flanks in relation to the direction of rotation of the piston. The offset of the combustion space recesses 14, 15 and 16 is matched to the offset of the spark plugs 8, 9 and 10 in such a manner that with the ignition of one of the spark plugs, the combustion space recess coordinated thereto assumes the same position as the next combustion space recess to the spark plug coordinated thereto. If the ignition takes place at an instant at which the piston 2 assumes the illustrated position shown in full line, then the spark plug 8 ignites into the combustion space recess 14 provided in the piston flank 11. After an angular path of the piston through 120°, the spark plug 9 ignites into the combustion space recess 15 provided in the piston flank 12 and after a further angular path of the piston through 120°, the spark plug 10 ignites into the combustion space recess 16 provided in the piston flank 13. At the ignition instant the combustion space recess 15 assumes the position 15*a* indicated in dash line with respect to the spark plug 9 whereas at its ignition instant the combustion space 16 assumes with respect to the spark plug 10 the position 16*a* indicated in dotted lines.

As a result of the arrangement of the alternately igniting spark plugs 8, 9 and 10 and by the coordination of the position of the combustion space recesses 14, 15 and 16 to the spark plugs 8, 9 and 10, it is achieved that at the ignition of the spark plug 8, the point of concentration of the combustion and therewith the thermal load and stress lies within the area 17 of the running surface 5 and of the housing casing 1 whereas during the ignition of the spark plug 9, the point of concentration lies displaced in the circumferential direction within the area 18 and during the ignition of the spark plug 10 still further displaced within the area 19. The thermal load will therefore be distributed over a larger area of the running surface so that overheating appearances are avoided.

While I have shown and described only one embodiment in accordance with the present invention, it is understood that the same is not limited thereto but is susceptible of numerous changes and modifications as known to those skilled in the art. For example, the number of corners of the piston and number of arcs in the housing casing may be varied as also the number of spark plugs which are alternately or sequentially energized. Hence, I do not wish to be limited to the details shown and described herein but intend to cover all such changes and modifications as are encompassed by the scope of the appended claims.

I claim:

1. A rotary piston internal combustion engine with a polygonal piston means with a multi-arched housing casing means, in which the piston means is provided in its piston flanks with combustion space recess means into which takes place the ignition, characterized in that the combustion space recess means provided in a piston flank is arranged circumferentially offset with respect to the combustion space recess means provided in at least one other piston flank.

2. An internal combustion engine according to claim 1, characterized in that the engine is of trochoidal construction.

3. An internal combustion engine according to claim 2, characterized in that in a respective piston flank the combustion space recess means provided therein is arranged offset with respect to each combustion space recess means in other piston flanks.

4. A rotary piston internal combustion engine according to claim 1, characterized in that each piston flank the combustion space recess means provided therein is arranged offset in relation to each other combustion space recess means.

5. An internal combustion engine according to claim 4, characterized in that the combustion space recess means are arranged offset in the circumferential direction of the piston means.

6. An internal combustion engine according to claim 5, characterized in that at least two spark plug means are provided in the housing casing means, and in that means for effecting alternate ignition are provided with respectively only one ignition being effected in one combustion space recess means.

7. An internal combustion engine according to claim 6, in which a triangular piston means rotates with a two-arched housing casing means, characterized in that three spark plug means for providing ignition sparks are arranged offset in the circumferential direction in the housing casing means, each of said spark plug means providing an ignition spark in a combustion space recess means in a respective piston flank whose offset in the circumferential direction of the piston means corresponds to the offset of the corresponding spark plug means.

8. An internal combustion engine according to claim 7, characterized in that the engine is of trochoidal construction.

9. An internal combustion engine according to claim 1, characterized in that the combustion space recess means are arranged offset in the circumferential direction of the piston means.

10. An internal combustion engine according to claim 1, characterized in that at least two spark plug means are provided in the housing casing means, and in that means for effecting alternate ignition are provided with respectively only one ignition being effected in one combustion space recess means.

11. An internal combustion engine according to claim 1, in which a triangular piston means rotates within a two-arched housing casing means, characterized in that three spark plug means for providing ignition sparks are arranged offset in the circumferential direction in the housing casing means, each of said spark plug means providing an ignition spark in a combustion space recess means in a respective piston flank whose offset in the circumferential direction of the piston means corresponds to the offset of the corresponding spark plug means.

* * * * *